US007426353B1

(12) United States Patent
Sakakibara

(10) Patent No.: US 7,426,353 B1
(45) Date of Patent: Sep. 16, 2008

(54) IMAGE FORMING APPARATUS WITH VARIABLE CONVEY SPEED CONTROL BETWEEN TRANSFER DEVICE AND FIXING DEVICE

(75) Inventor: Hiroyuki Sakakibara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 100 days.

(21) Appl. No.: 11/559,603

(22) Filed: Nov. 14, 2006

(30) Foreign Application Priority Data

Dec. 9, 2005 (JP) ..... 2005-356415
Oct. 4, 2006 (JP) ..... 2006-272636

(51) Int. Cl.
*G03G 15/00* (2006.01)
*G03G 15/20* (2006.01)

(52) U.S. Cl. ..... 399/68; 399/16; 399/400; 399/401

(58) Field of Classification Search ..... 399/68, 399/401, 400, 16
See application file for complete search history.

(56) References Cited

U.S. PATENT DOCUMENTS 4,941,021 A 7/1990 Uchida et al. ..... 399/322
6,564,025 B2 5/2003 Sameshima et al. ..... 399/68
2002/0141773 A1* 10/2002 Nakamura ..... 399/68
2003/0202809 A1* 10/2003 Tanaka ..... 399/68 X
2005/0025544 A1* 2/2005 Yamashita et al. ..... 399/401
2006/0222386 A1* 10/2006 Koshida et al. ..... 399/68 X
2006/0222394 A1* 10/2006 Koshida ..... 399/68
2007/0223951 A1* 9/2007 Kietzman ..... 399/68

FOREIGN PATENT DOCUMENTS

JP 62-161182 7/1987
JP 05-107966 4/1993
JP 2001-282072 10/2001
JP 2003-241453 8/2003

* cited by examiner

*Primary Examiner*—Sophia S Chen
(74) *Attorney, Agent, or Firm*—Fitzpatrick, Cella, Harper & Scinto

(57) ABSTRACT

In a construction for forming images on the both surfaces of a sheet, a speed controlling device for effecting the conveyance control of the sheet between a transfer device and a fixing device controls, when the image is to be formed on a first surface, the sheet conveying speed between the transfer device and the fixing device on the basis of loop detection by a loop detecting sensor provided between the transfer device and the fixing device so that a loop formed in the sheet may be maintained within a predetermined range. Also, when the image is to be formed on a second surface, the speed controlling device controls the sheet conveying speed between the transfer device and the fixing device on the basis of the average sheet conveying speed between the transfer device and the fixing device when the image has been formed on the first surface.

7 Claims, 12 Drawing Sheets

IMAGE FORMING APPARATUS WITH VARIABLE CONVEY SPEED CONTROL BETWEEN TRANSFER DEVICE AND FIXING DEVICE

BACKGROUND OF THE INVENTION

1. Field of the Invention

The invention relates to an image forming apparatus, and particularly to a construction for forming images on the both surfaces of a sheet.

2. Description of the Related Art

There has heretofore been an image forming apparatus using an electrophotographic printing method which is constructed so as to form images on the both surfaces of a sheet. In such an image forming apparatus, a toner image formed on an image bearing member is transferred to a sheet in a transfer device, whereafter the sheet is directed to a fixing device, and the toner image is fixed on the sheet. Further, when images are to be formed on the both surfaces of a sheet, a first surface and a second surface of a sheet having an image formed on the first surface is reversed, and a toner image is transferred to and fixed on the second surface of the sheet to thereby form images on the both surfaces of the sheet.

Now, depending on the length of the sheet, there is a case where the leading edge of the sheet has entered the fixing device, the trailing edge thereof has not yet passed through the transfer device. Usually, the sheet conveying speed of the fixing device and the sheet conveying speed of the transfer device are set substantially equally. However, there is a case where a difference occurs between the sheet conveying speeds of the fixing device and the transfer device due to the thermal expansion and individual difference or changes with time of a pressure roller provided in the fixing device.

When the sheet conveying speed of the fixing device is higher than the sheet conveying speed of the transfer device, there may occur the phenomenon that the sheet bearing an unfixed toner image thereon is pulled toward the fixing device side between the fixing device and the transfer device, thus resulting in image deterioration in the transfer device.

So, in order to prevent the occurrence of such a phenomenon that the sheet is pulled, a loop is adapted to be formed in the sheet conveyed between the transfer device and the fixing device to thereby slacken the sheet. By the sheet being adapted to be thus slackened, the occurrence of the phenomenon that the sheet is pulled between the transfer device and the fixing device is prevented.

Conversely, when the sheet conveying speed of the transfer device is extremely higher than the sheet conveying speed of the fixing device, a loop more than necessary is formed in the sheet and the separating direction of the sheet after the image transfer in the transfer device, the angle of incidence of the sheet onto the fixing device, etc. become unstable. In this case, the scattering of the image during the transfer separation of the sheet, the offset in the fixing device, etc. occur.

Accordingly, in the conventional image forming apparatus, it is desirable that the sheet be conveyed with a moderate loop formed therein between the transfer device and the fixing device and therefore, as regards the relation between the sheet conveying speeds of the transfer device and the fixing device, it becomes necessary that the two sheet conveying speeds be set to substantially equal speeds or the sheet conveying speed of the fixing device be set to a somewhat lower speed.

So, as the conventional image forming apparatus, there is one provided with speed control means for changing and controlling the circumferential speed of the roller of the fixing device to a first circumferential speed lower than the speed at which the sheet is conveyed in the transfer device and a second circumferential speed higher than this first circumferential speed, as disclosed in U.S. Pat. No. 4,941,021. In this apparatus, at a point of time whereat the leading edge of the sheet arrives at the roller of the fixing device, the circumferential speed of this roller is the first circumferential speed, and after the lapse of a predetermined time from after the leading edge of the sheet has arrived at the roller of the fixing device, the circumferential speed of this roller is changed from the first circumferential speed to the aforementioned second circumferential speed.

Also, in another image forming apparatus, as disclosed, for example, in Japanese Patent Application Laid-open No. S62-161182, the driving speed of the roller of the fixing device is controlled so as to be lower than the driving speed of the transfer device for a predetermined time from immediately before a sheet to which a toner image has been transferred enters the fixing device.

Further, there is a conventional image forming apparatus which is provided with a loop detecting sensor in the conveying guide between the transfer device and the fixing device to properly control the loop formed between the transfer device and the fixing device. In this image forming apparatus, the loop of the sheet is detected by the loop detecting sensor, and from the result of this detection, the speed of a motor for driving the pressure roller of the fixing device is changed over to thereby control the size of the loop of the sheet so as to be kept within a predetermined range.

As such an image forming apparatus, there is one designed such that as disclosed in Japanese Patent Application Laid-open No. H05-107966, when the loop of the sheet is judged to be a reference amount or less by the detection by the loop detecting sensor, the sheet conveying speed of the fixing device is made lower than the sheet conveying speed of the transfer device, and when the loop amount of the sheet is judged to be greater than the reference amount, the sheet conveying speed of the fixing device is made higher than the sheet conveying speed of the transfer device.

Also, as the sensor for detecting the loop, there is one described, for example, in U.S. Pat. No. 6,564,025. As this one, there has been proposed one having a construction in which a fixing entrance guide itself is urged by a spring force and the loop amount of the sheet is detected by the oscillated state thereof and also, the detected information is fed back to a fixing motor.

Also, for example, in Japanese Patent Application Laid-open No. 2003-241453, there is proposed a construction in which a flag-shaped loop sensor is disposed in a fixing entrance guide, and the loop amount of a sheet is detected by the ON-OFF output thereof, and the detected information is fed back to a fixing motor.

Now, in an image forming apparatus provided with such a loop detecting sensor, there is a case where when images are to be formed on both of the front surface and back surface of a sheet, the loop detection by the loop detecting sensor cannot be reliably effected and the faulty conveyance of the sheet is caused. As the cause of this, the following is conceivable.

When an image is to be formed on a first surface (front surface) of a so-called moisture-absorbent sheet left under a high-temperature and high-humidity environment, when the sheet is heated by the fixing device, a great deal of steam is discharged also to a space downstream of the fixing device. The steam thus discharged in a great deal thereafter adheres to the sheet itself which has discharged the steam, or to the front surface of the sheet passing through a fixing nip portion thereafter.

When the steam thus adheres to the front surface, and when an image is to be formed on a second surface (back surface) of the sheet, in a case where the sheet having entered the fixing device after image transfer is conveyed by the fixing nip portion, the sheet cannot be firmly gripped in the fixing nip portion due to the influence of the steam having adhered to the front surface. As the result, there occurs the phenomenon that the sheet slips, i.e., the so-called slip phenomenon.

When here, in a state in which such a slip phenomenon has occurred, the sheet conveying speed of the fixing device is controlled so as to be lower than the sheet conveying speed of the transfer device, the amount of stack may sometimes momentarily great. In such case, the loop detecting sensor becomes incapable of detecting the loop and the control of the loop becomes impossible. As the result, the unfixed image printed surface rubs in a conveying path and a defective image results. That is, when images are to be formed on the both surfaces of the moisture-absorbent sheet, if an appropriate loop cannot be formed stably in the sheet between the transfer device and the fixing device, there arises the problem that the rubbing of the image occurs and an appropriate image cannot be formed on the sheet.

Also, if the sheet is nipped at a high temperature and under high pressure in the fixing device when an image is to be formed on a first surface thereof, a curl may sometimes be formed in the sheet, and an image is formed on a second surface of the sheet with a curl formed in the sheet and therefore, the sheet may sometimes be conveyed again to the transfer device and the fixing device. If in such case, a curl in a direction away from the loop detecting sensor is formed in the sheet, the loop detecting sensor will become incapable of detecting the loop in spite of the loop being formed and the control of the loop will become impossible. Thereby, the same problem as described above will arise.

SUMMARY OF THE INVENTION

So, the present invention has been made in view of such present situation and has as its object to provide an image forming apparatus which can form appropriate images on the both surfaces of a sheet.

The present invention provides an image forming apparatus for transferring and fixing a toner image on a first surface of a sheet in an image forming portion, and thereafter reversing the sheet and again conveying the sheet to the image forming portion, and transferring and fixing a toner image on the second surface of the sheet to thereby form images on the both surfaces of the sheet, the image forming apparatus being provided with a transfer device for transferring the toner images to the sheet, a fixing device for fixing the toner images transferred by the transfer device on the sheet, and speed controlling means for controlling the sheet conveying speed between the transfer device and the fixing device, wherein in a case of forming the image on the first surface of the sheet, the speed controlling means controls the sheet conveying speed between the transfer device and the fixing device on the basis of an amount of a loop formed in the sheet by the difference between the sheet conveying speeds of the transfer device and the fixing device, and in a case of forming the image on the second surface of the sheet, the speed controlling means controls the sheet conveying speed between the transfer device and the fixing device on the basis of the average sheet conveying speed of the sheet conveyed between the transfer device and the fixing device when the image has been formed on the first surface.

Further features of the present invention will become apparent from the following description of exemplary embodiments with reference to the attached drawings.

DESCRIPTION OF THE PREFERRED EMBODIMENTS

The best form for carrying out the present invention will hereinafter be described in detail with reference to the drawings.

Figure 1:
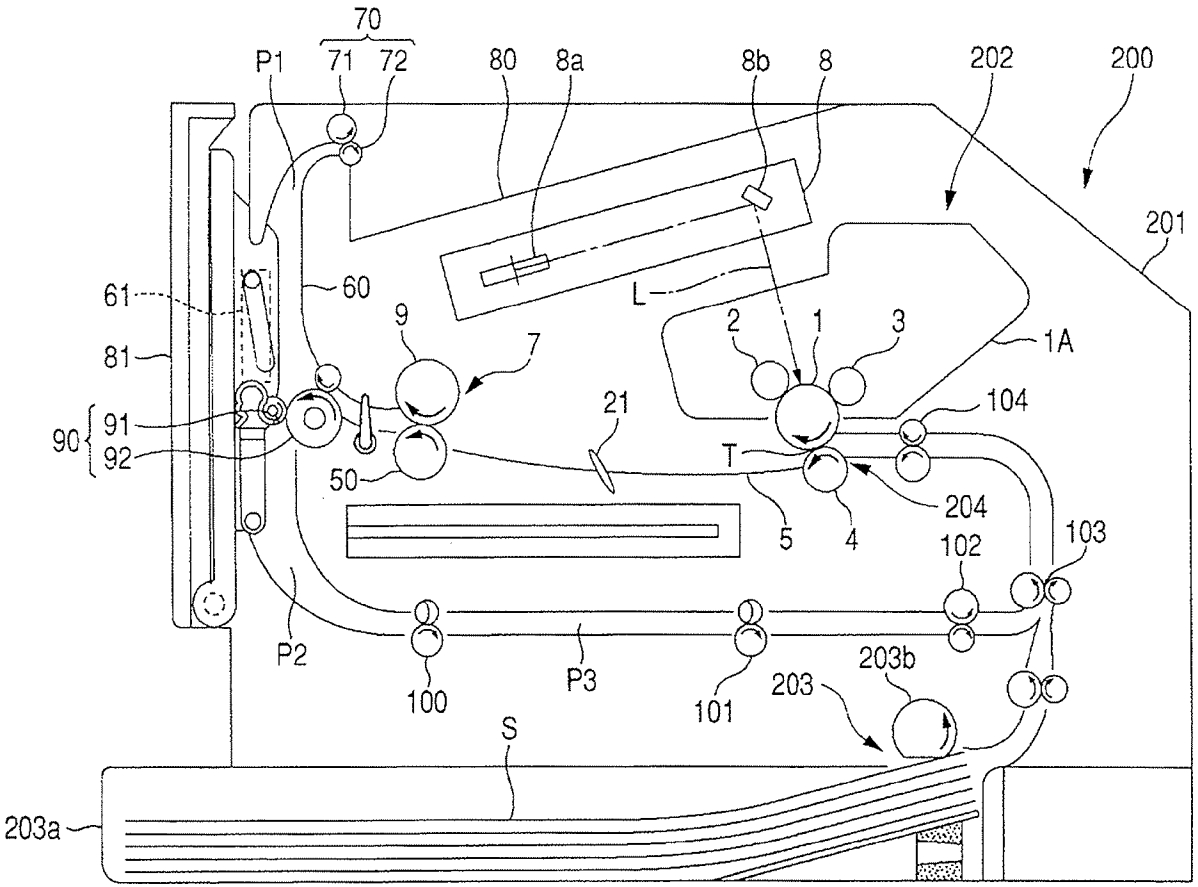
FIG. 1 schematically shows the construction of a laser beam printer which is an example of an image forming apparatus according to a first embodiment of the present invention.

FIG. 1 schematically shows the construction of a laser beam printer which is an example of an image forming apparatus according to a first embodiment of the present invention.

In FIG. 1, the reference numeral 200 designates the laser beam printer, and the reference numeral 201 denotes a laser beam printer main body (hereinafter referred to as the printer main body). This laser beam printer 200 is provided with an image forming portion 202 and a feeding portion 203 for feeding a sheet S to the image forming portion 202. The image forming portion 202 is comprised of a process cartridge 1A which will be described later, a laser scanner 8, a transfer device 204 for transferring a toner image to the sheet S, a fixing device 7 for fixing the toner image transferred by the transfer device, etc.

Here, the process cartridge 1A is provided with a photosensitive drum 1, a charging roller 2, a developing sleeve 3, a toner container (not shown), etc. The laser scanner 8 is provided with a laser beam emitting portion (not shown), a rotating polygon mirror 8*a*, a turn-back mirror 8*b*, etc., and exposes the surface of the photosensitive drum 1 to light to thereby form an electrostatic latent image on the photosensitive drum.

Also, the feeding portion 203 is provided with a sheet feeding tray 203*a* stacking sheets S thereon, and a feed roller 203*b* for feeding the sheets S on the sheet feeding tray 203*a* one by one.

The transfer device 204 is constituted by the photosensitive drum 1, and a transfer roller 4 brought into pressure contact with the photosensitive drum 1 to thereby form a transfer nip T and also, transfer a toner image on the photosensitive drum 1 to the sheet S when the sheet S passes through this transfer nip T. The fixing device 7 will be described later.

Description will now be made of the image forming operation in the thus constructed laser beam printer 200.

When the image forming operation is started, the photosensitive drum 1 is first rotated in the direction indicated by the arrow, and is uniformly charged to a predetermined polarity and predetermined potential by the charging roller 2. A laser beam L is emitted from the laser beam emitting portion of the laser scanner 8 to the photosensitive drum 1 after the surface thereof has been charged, on the basis of image information, and this laser beam L is applied via the polygon mirror 8*a* and the turn-back mirror 8*b*. Thereby an electrostatic latent image is formed on the photosensitive drum 1.

Next, this electrostatic latent image is developed and visualized as a toner image by a toner subjected to moderate charging being supplied onto the photosensitive drum 1 with the rotation of the developing sleeve 3 and adhering to the electrostatic latent image.

On the other hand, one of the sheets S stacked on the sheet feeding tray 203*a* is fed out by the feed roller 203*b* in parallel with such a toner image forming operation, and thereafter is conveyed to the transfer device 204 at predetermined timing by registration rollers 104. Then, in this transfer device 204, the toner image formed on the photosensitive drum 1 is transferred to a predetermined location on the sheet S by the transfer roller 4. In the present embodiment, the toner charged to the minus polarity is transferred to the sheet S by a transfer bias of the plus polarity being applied to the transfer roller 4.

Next, the sheet S to which the toner image has been thus transferred is conveyed to the fixing device 7, where the unfixed toner image is heated and pressurized and is fixed on the front surface of the sheet. The sheet S after the toner image has been fixed thereon in this manner, when it is stacked with its print surface facing downwardly (face-down stacking), is thereafter conveyed to a common conveying path P1 made by a conveying surface 60 and a rockable guide 61 opposed thereto.

Then, the sheet S is discharged onto a face-down sheet discharge tray 80 provided in the upper portion of the printer main body 201 by a pair of sheet discharging rollers 70 constituted by a sheet discharging roller 71 provided with a drive source (not shown) and a driven runner 72 brought into pressure contact therewith and driven to rotate thereby.

Also, when the sheets are stacked with their print surfaces facing upwardly (face-up stacking), a face-up sheet discharge tray unit 81 openably and closably provided in the printer main body 201 is opened to thereby form a stack tray, and the sheets S are stacked thereon. The surface of the photosensitive drum after the transfer of the toner image to the sheet S is subjected to the process of removing any residual adhering substance such as any untransferred toner by cleaning means 6 shown in FIG. 2 which will be described later, and is repetitively used for image forming.

Here, the present laser beam printer 200 has the both-surface image forming function, and when a both-surface image forming mode is set, the pair of sheet discharging rollers 70 are reversely rotated after the sheet S has entered the common conveying path P1, and the first surface and second surface of the sheet S are reversed. Thereby, the sheet S is conveyed by a pair of common rollers 90 constituted by a driven runner 91 and a common roller 92, and is conveyed to a re-conveying path P3 via a reversing and conveying path P2. Then, the sheet S is conveyed again to the pair of conveying rollers 103 through pairs of oblique-feed rollers 100, 101 and a pair of re-feed rollers 102 provided in the re-conveying path P3. Thereafter, as in the case of the front surface print, image formation on the back surface is done.

Figure 2:
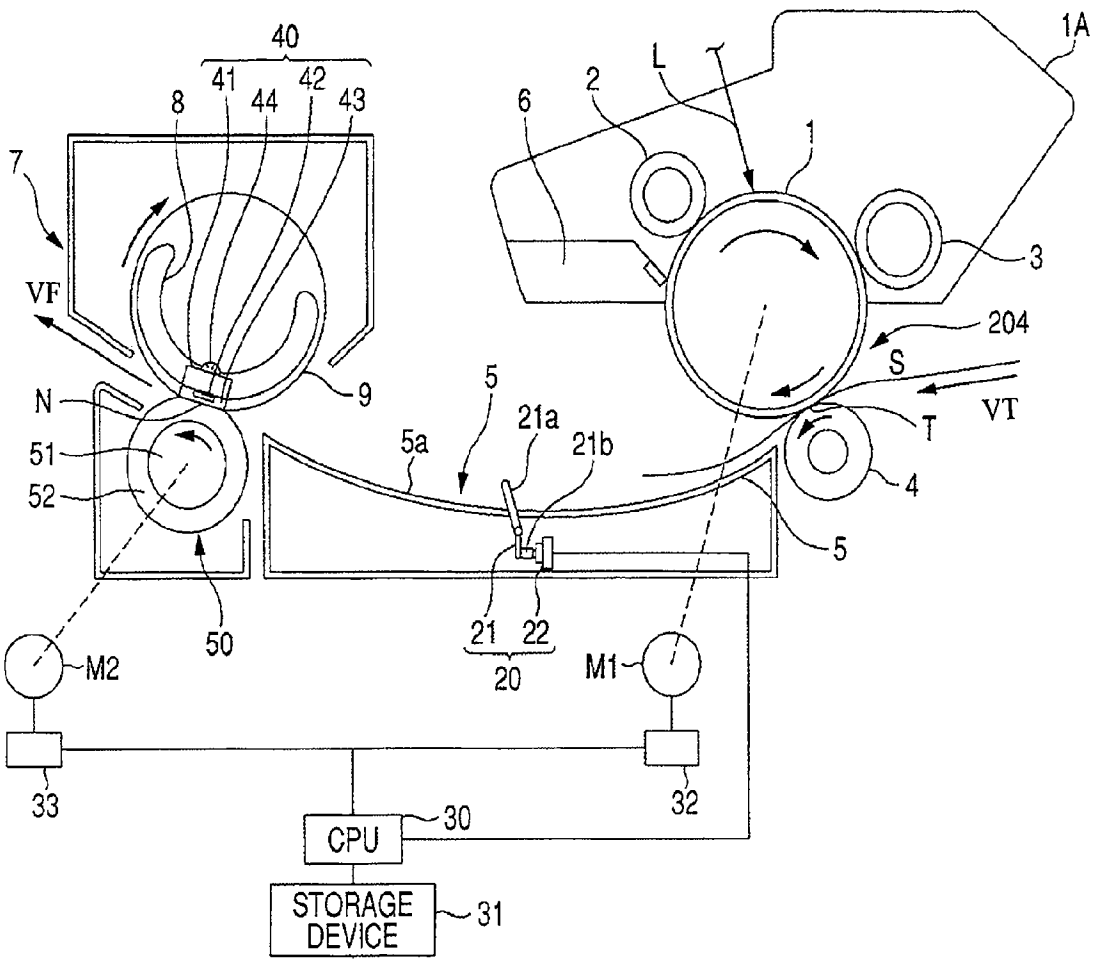
FIG. 2 is an enlarged view of a transfer device and a fixing device provided in the laser beam printer.

Now, in the present embodiment, the fixing device 7 is constituted by a heating apparatus using a film heating method of a pressure member driving type and a tensionless type. This fixing device 7, as shown in FIG. 2, is provided with fixing film 9 which is endless heat-resistant film, and a laterally long stay 8 made of heat-resistant resin including a heater 40 and also, having the fixing film 9 fitted thereon, and providing an inner surface guide member for the fixing film 9. Also, it is provided with a pressure roller 50 as a rotary member forming a fixing nip N which is a pressure contact nip between itself and the heater 40 as a heating member with the fixing film 9 interposed therebetween, and driving the fixing film 9.

The heater 40 comprises a substrate 41 formed of alumina or the like which is a high heat-conductive material, and an electrical resistance material (heat generating member) 42 such as, for example, Ag/Pd (silver palladium) applied to the surface of the substrate 41 on the substantially central portion thereof along the length thereof to a thickness of about 10 μm and a width of 1-3 mm by screen printing or the like. This heat generating member 42 is coated with glass, fluorine resin or the like as a protective layer 43. The reference numeral 44 designates a thermistor which effects the electrical energization of the heat generating member 42.

Also, the pressure roller 50 comprises a core metal 51 of aluminum, iron, stainless steel or the like, and a heat-resistant rubber elastic member 52 of good mold releasability such as silicone rubber exteriorly packaging this core metal 51. In the present embodiment, the heat-resistant rubber elastic member 52 has a thickness of 3 mm and an outer diameter of 20 mm, and the surface thereof is provided with a coat layer having fluorine resin dispersed therein for the reason of the conveying property of the sheet S and the fixing film 9, and the prevention of the contamination of the toner.

In the fixing device 7 of such a construction, the pressure roller 50 is rotatively driven in a counter-clockwise direction indicated by the arrow by the end portion of the core metal 51 being driven by a fixing motor M2 which will be described later. By this driving force, the fixing film 9 is rotatively driven in a clockwise direction while the inner surface thereof slides in close contact with the heater 40.

That is, when the pressure roller 50 is rotatively driven, a moving force is exerted on the fixing film 9 in the fixing nip by the frictional force with the pressure roller 50. Thereby, the fixing film 9 is rotatively driven in the clockwise direction substantially at the same speed as the rotating circumferential speed of the pressure roller 50 while the inner surface of the film slides on the surface of the heater 40 (the surface of the protective layer 43).

In a state in which the fixing film 9 is thus driven and also, the electrical energization of the heat generating member 42 of the heater 40 is effected, the sheet S bearing the unfixed toner image thereon is made to enter the fixing nip N with its image bearing surface facing upwardly. Thereby, in the fixing nip N, the heat energy of the heater 40 which is in contact with the inner surface of the fixing film is imparted to the sheet S through the fixing film 9, and the toner momentarily becomes fused. Then, in the fixing nip N, the fused toner is pressurized against the sheet S, whereby the toner image is permanently fixed.

Here, as regards the relation between the sheet conveying speeds of the transfer device 204 and the fixing device 7 and the loop amount formed therebetween, when the sheet conveying speed of the fixing device 7 (the sheet conveying speed in the fixing nip N) VF is made lower than the sheet conveying speed VT of the transfer device 204, the loop amount is increased. Conversely, when the sheet conveying speed VF of the fixing device 7 is made higher than the sheet conveying speed VT of the transfer device 204, the loop amount is decreased. Here, in the present embodiment, the sheet conveying speed VT of the transfer device 204 is a constant speed and therefore, the sheet conveying speed VF of the fixing device 7 is increased or decreased, whereby the loop amount is controlled.

In FIG. 2, the reference numeral 5 denotes a conveying guide for conveying to the fixing device 7 the sheet S having received the transfer of the toner image in the transfer device 204, and thereafter separated from the surface of the photosensitive drum 1. On this conveying guide 5, there is provided a loop detecting sensor 20 which is loop detecting means for detecting whether the loop amount of the sheet S has exceeded a reference amount.

This loop detecting sensor 20 is provided with a rockable detecting flag 21 disposed so that one end portion 21*a* thereof may protrude to the conveying surface 5*a* of the conveying guide 5, and a photointerrupter 22 adapted to be turned on/off in accordance with the rocking movement of the detecting flag 21.

Here, the detecting flag 21 is urged by a spring member (not shown) so that the one end portion 21*a* may protrude from the conveying surface 5*a* of the conveying guide 5, and when a loop is formed in the sheet S, it is downwardly pressed by the sheet S and is rocked in accordance with the loop amount of the sheet S. Also, on the other end of the detecting flag 21, there is provided a flag 21*b* extending downwardly of the conveying surface 5*a*, and this flag 21*b* closes/opens the optical path of the photointerrupter 22 in operative association with the movement of the detecting flag 21. That is, the photointerrupter 22 is turned on/off in accordance with the rocking movement of the detecting flag 21.

Description will now be made of the loop control of the sheet between the transfer device 204 and the fixing device 7 using the loop detecting sensor 20 in the present embodiment. In the present embodiment, the transfer device 204 is set to a constant sheet conveying speed, and the sheet conveying speed of the fixing device 7 is increased or decreased to thereby control the loop amount formed in the sheet. The sheet conveying speed of the fixing device 7 is set so as to be changed over to two speeds, i.e., a first sheet conveying speed V1 which is a speed lower than the sheet conveying speed VT of the transfer device 204, and a second sheet conveying speed V2 higher than the sheet conveying speed VT of the transfer device 204.

First, when the sheet conveying speed of the fixing device 7 is set to the first sheet conveying speed V1 lower than the sheet conveying speed VT of the transfer device 204, the loop amount of the sheet is increased. By the loop amount being increased, whereby the loop detecting sensor 20 is turned on, and by this ON signal, the sheet conveying speed of the fixing device 7 is changed over to the second sheet conveying speed V2 higher than the sheet conveying speed VT of the transfer device 204. When the sheet conveying speed of the fixing device 7 is set to the second sheet conveying speed V2, the loop amount of the sheet is decreased. By the loop amount being decreased, the loop detecting sensor 20 is turned off, and by this OFF signal, the sheet conveying speed of the fixing device 7 is again changed over to the first sheet conveying speed V1 lower than the sheet conveying speed of the transfer device 204.

As described above, the sheet conveying speed of the fixing device 7 is changed over to the first sheet conveying speed V1/the second sheet conveying speed V2 in accordance with the ON/OFF of the loop detecting sensor 20, and the loop amount formed in the sheet is increased or decreased. Here, the light emitting portion of the photointerrupter 22 has a constant width, and the ON (closed) state thereof is maintained within the constant rocking movement amount of the detecting flag 21. Further, the changeover timing of the sheet conveying speed of the fixing device 7 during the ON/OFF of the loop detecting sensor 20 is delayed by a constant time from the outputting of the ON/OFF signal. By these, the loop amount formed in the sheet is maintained within a predetermined range.

As described above, the changeover of the sheet conveying speed of the fixing device 7 is effected at the predetermined timing on the basis of the detection by the loop detecting sensor 20, and this changeover timing is set as follows. When the loop amount of the sheet is increased, the sheet conveying speed of the fixing device 7 is changed over from the first sheet conveying speed V1 to the second sheet conveying speed V2 before the sheet contacts with the conveying guide 5. Also, when the loop amount of the sheet is decreased, the sheet conveying speed of the fixing device 7 is changed over from the second sheet conveying speed V2 to the first sheet conveying speed V1 before the sheet stretches to its full length.

In FIG. 2, the reference character M1 designates a main motor for rotatively driving the photosensitive drum 1 at a predetermined process speed (circumferential speed), and the reference numeral 32 denotes a controller for controlling the driving of the main motor M1, and it is controlled by a CPU 30. The transfer roller 4 is connected to the photosensitive drum 1 through a gear, and like the photosensitive drum 1, it is rotatively driven with the main motor M1 as a drive source.

The reference character M2 denotes a fixing motor which is driving means for driving the pressure roller 50 of the fixing device 7, and by this fixing motor M2, the pressure roller 50 is rotatively driven in the counter-clockwise direction, and the fixing film 9 is driven to rotate by the rotation of this pressure roller 50. Also, this fixing motor M2 is drive-controlled by the CPU 30 through a controller 33.

Here, in the present embodiment, the CPU 30 controls the main motor M1 and the fixing motor M2 so that the sheet conveying speed may be a process speed VP (=120 mm/sec.).

The rotating speed of this fixing motor M2 is sequentially stored in a storage device 31. The CPU 30 which is speed controlling means for controlling the sheet conveying speed of the fixing device 7 on the basis of the rotating speed of the fixing motor M2 sequentially stored in this storage device 31 is adapted to find the average rotating speed of the fixing motor M2 during image formation on the first surface which will be described later.

Figure 3:
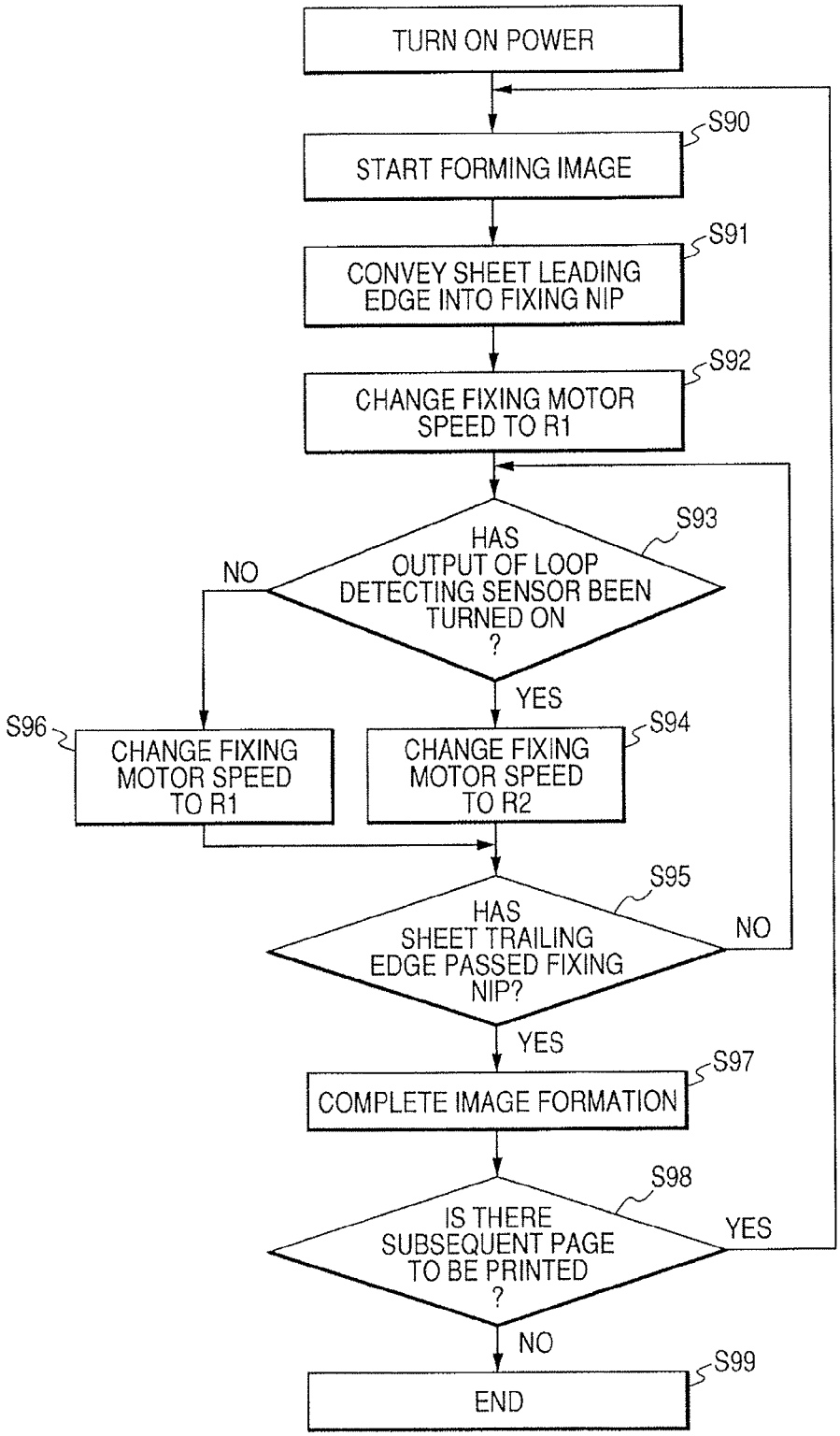
FIG. 3 is a flow chart showing the sheet conveying speed control of the fixing device.

The control of the sheet conveying speed of the fixing device 7 by such a CPU 30 will now be described with reference to a flow chart shown in FIG. 3.

When a power supply is turned on and an image formation starting signal is inputted, the image formation on the first surface is started (S90). As the result, the unfixed toner is transferred to the sheet in the transfer device 204, whereafter the leading edge of the sheet S passes the loop detecting sensor 20 and enters the fixing nip N (S91).

Figure 4:
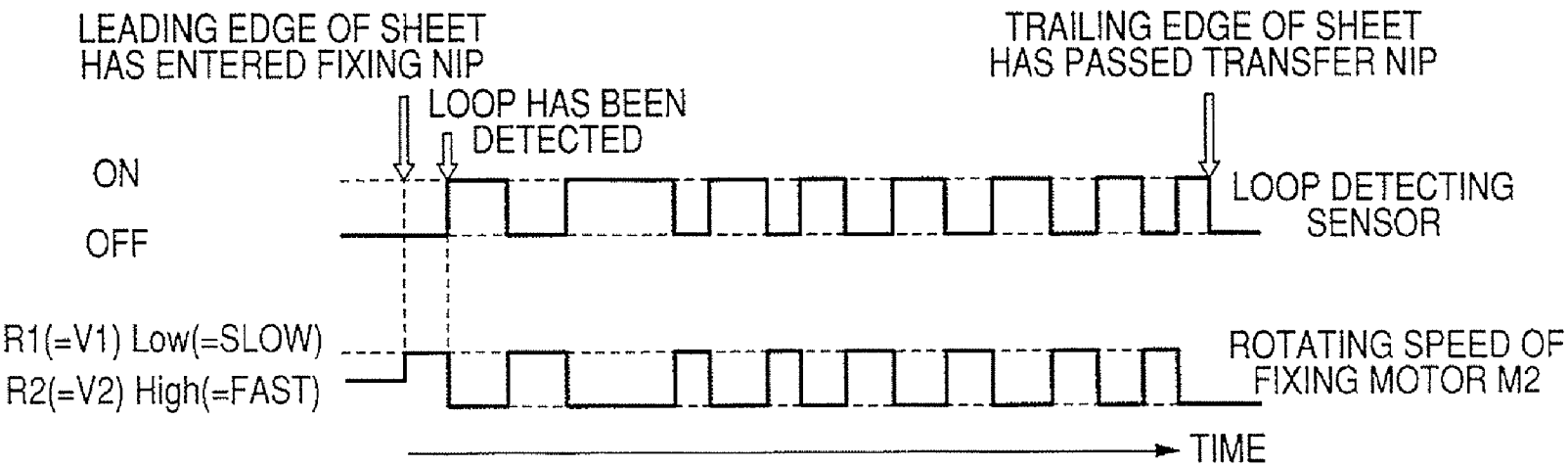
FIG. 4 shows the relation between the output of a loop detecting sensor provided between the transfer device and the fixing device and the rotating speed of a fixing motor.

When the leading edge of the sheet S enters the fixing nip N, the rotating speed of the fixing motor M2 is changed to R1 as shown in FIG. 4 (S92), and the sheet conveying speed VF of the fixing device 7 is set to the first sheet conveying speed V1 which is a speed lower than the sheet conveying speed VT of the transfer device 204.

Here, the rotating speed R1 of the fixing motor M2 is a rotating speed by which the sheet conveying speed VF of the fixing device 7 becomes lower than the sheet conveying speed VT (=VP) of the transfer device 204 which is a reference speed. It is necessary that the first sheet conveying speed V1 be set so that in any situation, VT>V1 (=VF) without fail, with the type of the sheet S, the number of continuously supplied sheets, the thermal expansion of each part according to the fixing temperature control situation, the irregularity of a pressure force, the tolerance of the roller diameter, etc. taken into account.

Figure 5A:
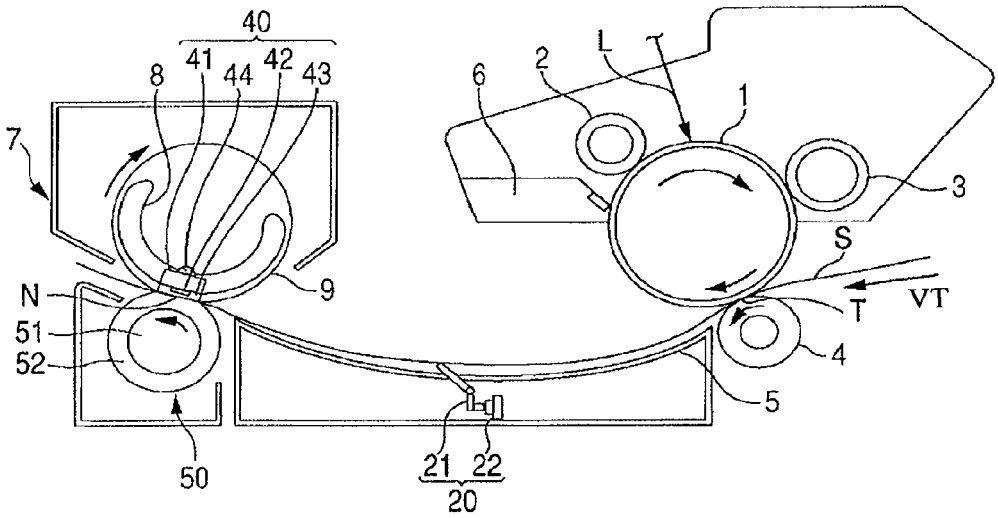
FIGS. 5A and 5B illustrate the state of a sheet passing between the transfer device and the fixing device.

Also, the timing at which the leading edge of the sheet S enters the fixing device 7 is calculated from the timing of the start of image formation by the CPU 30. Thereafter, the leading edge of the sheet S enters the fixing nip N via the detecting flag 21. By the sheet conveying speed VF of the fixing device 7 being set to the first sheet conveying speed V1 lower than the sheet conveying speed VT of the transfer device 204, and the sheet separating angle of the transfer device 204 and the angle of inclination of the fixing device 7, a downwardly convex loop shown in FIG. 5A is formed in the sheet S.

Until the leading edge of the sheet S arrives at the fixing device 7, even if the loop detecting sensor 20 is turned on, the CPU 30 does not receive this ON signal and does not effect the loop control of the sheet. After the sheet S has arrived at the fixing device 7, the CPU 30 receives the ON/OFF signal of the loop detecting sensor 20, and controls the sheet conveying speed of the fixing device 7 on the basis of the detection by the loop detecting sensor 20 to thereby effect the loop control of the sheet.

When the leading edge of the sheet S arrives at the fixing device 7, the sheet is conveyed at the first sheet conveying speed V1 of the fixing device 7 and therefore, the loop amount of the sheet S gradually becomes increased. Then, the loop amount formed in the sheet exceeds the reference amount and rocks the detecting flag 21 against the urging force of a spring member, whereby the photointerrupter is turned on and along therewith, the output of the loop detecting sensor 20 becomes ON (YES at S93). When the output of the loop detecting sensor 20 thus becomes ON (YES at S93), the CPU 30 judges that the loop amount of the sheet S has exceeded the reference amount, and changes the rotating speed of the fixing motor M2 from R1 to R2 (S94).

Thereby, the sheet conveying speed VF of the fixing device 7 becomes the second sheet conveying speed V2 higher than the sheet conveying speed VT of the transfer device 204, and by this speed difference, the loop amount of the sheet S between the transfer device 204 and the fixing device 7 is gradually decreased.

Here, it is necessary that this second sheet conveying speed V2 be also set so that in any situation, VT<V2 (=VF) without fail, with the type of the sheet S, the number of continuously supplied sheets, the thermal expansion of each part according to the fixing temperature control situation, the irregularity of the pressure force, the tolerance of the roller diameter, etc. taken into account. When the loop amount of the sheet S is decreased, the detecting flag 21 is rocked in a direction to return, and before the trailing edge of the sheet passes through the fixing nip N (NO at S95), the photointerrupter is turned off, and along therewith, the output signal of the loop detecting sensor 20 becomes OFF (NO at S93).

When the output of the loop detecting sensor 20 thus becomes OFF (NO at S93), the CPU 30 judges that the loop amount of the sheet S has become equal to or less than the reference amount, and changes the rotating speed of the fixing motor M2 from R2 to R1 (S96). Thereby, the sheet conveying speed VF of the fixing device 7 becomes the first sheet conveying speed V1 lower than the sheet conveying speed VT of the transfer device 204, and as the result, the loop amount of the sheet S between the transfer device 204 and the fixing device 7 is again increased.

Also, thereafter, when the output of the loop detecting sensor 20 becomes ON (YES at S93) before the trailing edge of the sheet passes through the fixing nip N (NO at S95), the CPU 30 changes the rotating speed of the fixing motor M2 from R1 to R2 (S94).

By repeating the control of changing the rotating speed of the fixing motor M2 to R1 or R2 in accordance with the output of the loop detecting sensor 20, as described above, it is possible to convey the sheet S while keeping the loop amount between the transfer device 204 and the fixing device 7 within a predetermined range. By repeating this operation until the trailing edge of the sheet passes through the transfer nip T, it is possible to maintain a conveyed state free of the occurrence of the excessive slack or pulling of the sheet.

Next, when the trailing edge of the sheet has passed through the fixing nip N (YES at S95), the image forming operation is completed (S97), whereafter if there is the subsequent page to be printed (YES at S98), S90 to S97 are repeated. Also, if the subsequent page to be printed is absent (NO at S98), the image forming operation is stopped (S99).

In the present embodiment, the rotating speed R1 (hereinafter expressed also as the low speed) of the fixing motor M2 is 1143 rpm, and R2 (hereinafter expressed also as the high speed) is 1185 rpm. These set values are variable by the gear train construction in the apparatus and the roller diameters and therefore, it is necessary to select optimum values at a suitable time.

Description will now be made of the sheet conveying speed control of the fixing device from the start of the image forming operation on the first surface (front surface) till the end of the image forming operation on the second surface (back surface).

First, when an image formation starting signal is inputted after the power supply of the laser beam printer 200 has been turned on, the leading edge of the sheet S to which the unfixed toner image has been transferred in the transfer device 204 passes through the transfer nip T, as shown in FIG. 2. Thereafter, the sheet S passes the loop detecting sensor 20 and enters the fixing nip N, and when the leading edge thereof enters the fixing nip N and the loop control is started, the rotating speed of the fixing motor M2 is first set to the low speed.

Thereafter, the rotating speed of the fixing motor M2 is changed over to the low speed and the high speed on the basis of the output of the loop detecting sensor 20 according to the sheet conveying state, whereby as shown in FIG. 5A, the sheet S is conveyed without excessive slack or pulling being caused. Thereafter, a toner image is transferred to the second surface of the sheet, whereafter the sheet is made to enter the fixing nip N.

Now, in a case where the sheet S to which the toner image has been transferred is a sheet left in a high-temperature and high-humidity environment, when the unfixed toner is fixed in the fixing nip N, moisture contained in the sheet S is also discharged into a space downstream of the fixing nip N in a great deal. Therefore, steam adheres also to the front surface of the sheet S itself which has passed through the fixing nip N.

When the sheet S to the front surface of which the steam has thus adhered has passed again through the transfer nip T and has entered the fixing nip N, it is impossible for the pressure roller 50 and the fixing film 9 to firmly grip and convey the sheet, and a slip phenomenon occurs. As the result, the sheet S having entered the fixing nip N cannot be conveyed at a regular conveying speed.

Therefore, when as the loop control, the sheet conveying speed is set to the low speed, it becomes a sheet conveying speed originally lower than the sheet conveying speed VT of the transfer device 204 and in addition, the sheet S is conveyed with a touch of slip, whereby the occurrence of the loop amount becomes earlier than usual. That is, the loop forming speed becomes higher than usual.

When the loop forming speed becomes high, in the case of the control of changing over the rotating speed of the fixing motor M2 from R1 to R2 in a case where the loop amount has exceeded the reference amount, the loop amount which is the reference amount is exceeded during the time from after the loop has been detected until the rotating speed is changed over to R2 to thereby begin to pull the sheet S. Thereby, in some cases, as shown in FIG. 5B, a partly convex loop L1 is formed on the loop detecting sensor 20.

Figure 5B:
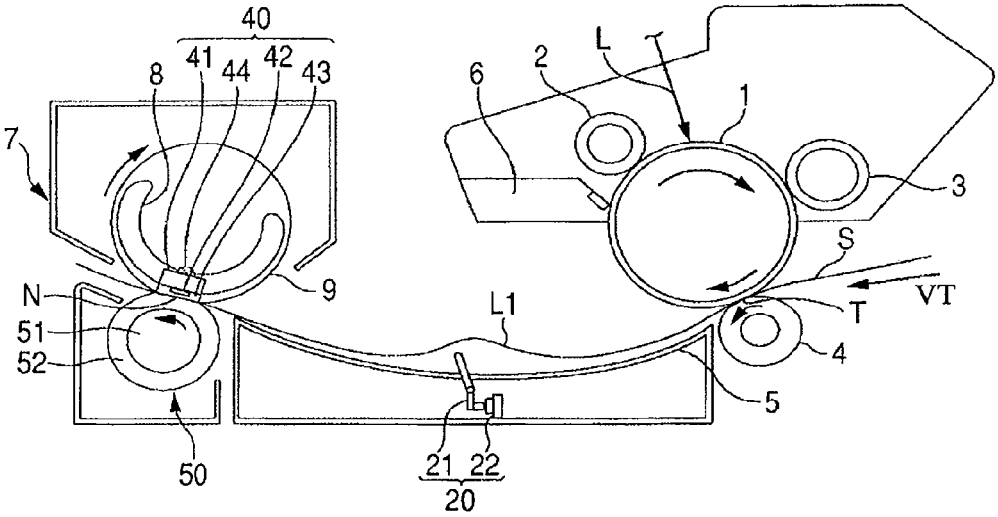
Figure 6:
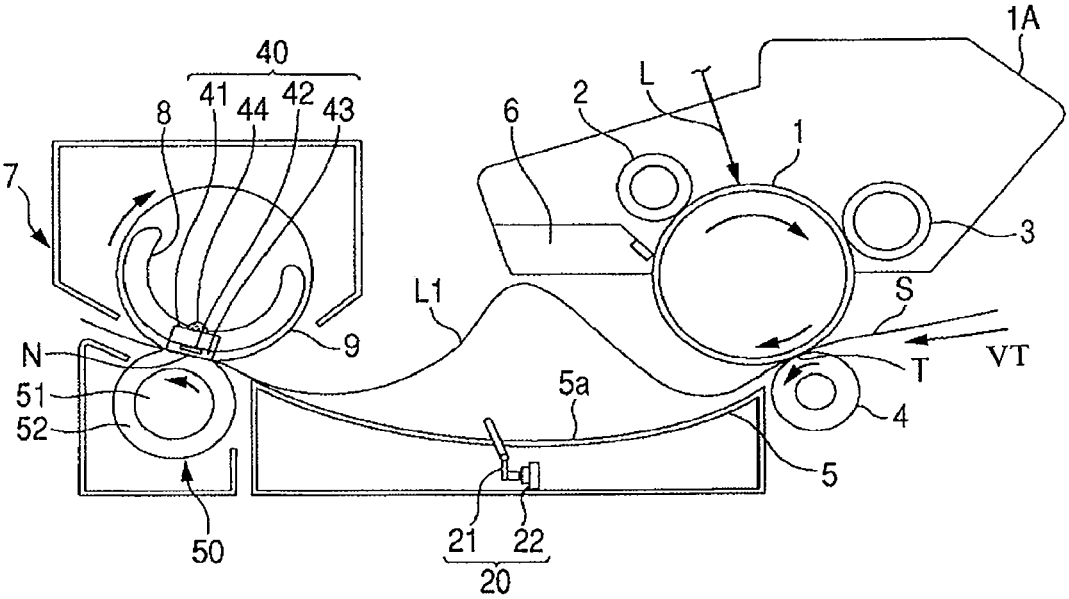
FIG. 6 shows a state in which a large loop has been formed in the sheet passing between the transfer device and the fixing device.

Here, when the sheet S once passes the loop detecting sensor 20 and brings about the state of FIG. 5B, the loop detecting sensor 20 becomes OFF. When the loop detecting sensor 20 becomes OFF, the sheet conveying speed is set to the low speed although originally the loop amount is great and therefore the sheet conveying speed must be set to the high speed. As the result, as shown in FIG. 6, the upward slack L1 is further increased and the print surface side of the sheet S rubs against the process cartridge 1A installed above to thereby bring about a defective image.

Figure 7A:
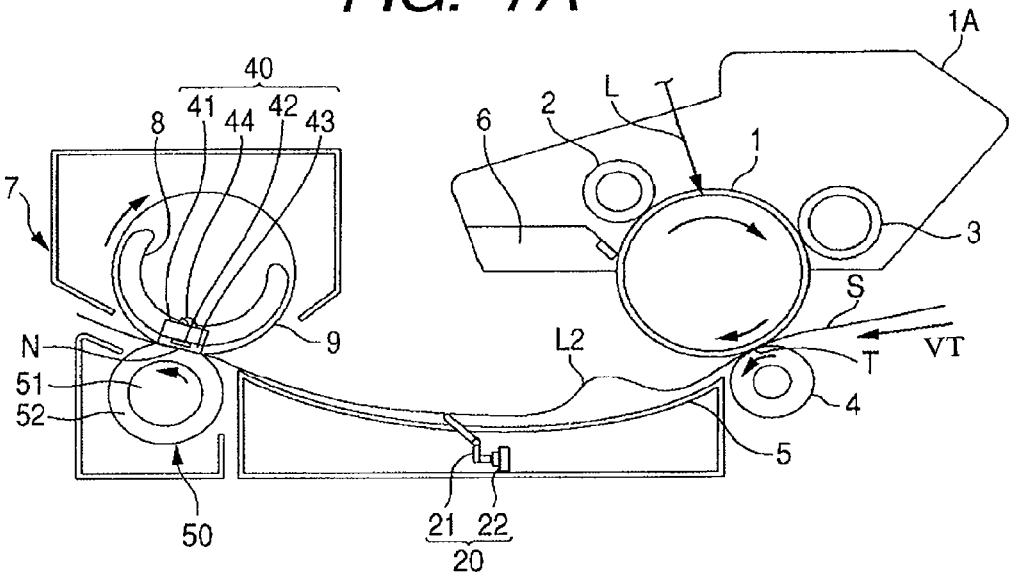
FIGS. 7A and 7B are views showing other states in which a large loop has been formed in the sheet passing between the transfer device and the fixing device.

Or as another case, even if such a slip phenomenon as will form an upwardly convex loop does not occur on the loop detecting sensor 20, when as the loop control, the sheet conveying speed is still set to the low speed, the sheet S is conveyed with a touch of slip in the fixing nip N. Therefore, there is a case where as shown in FIG. 7A, the distortion L2 of partial slack occurs.

Figure 7B:
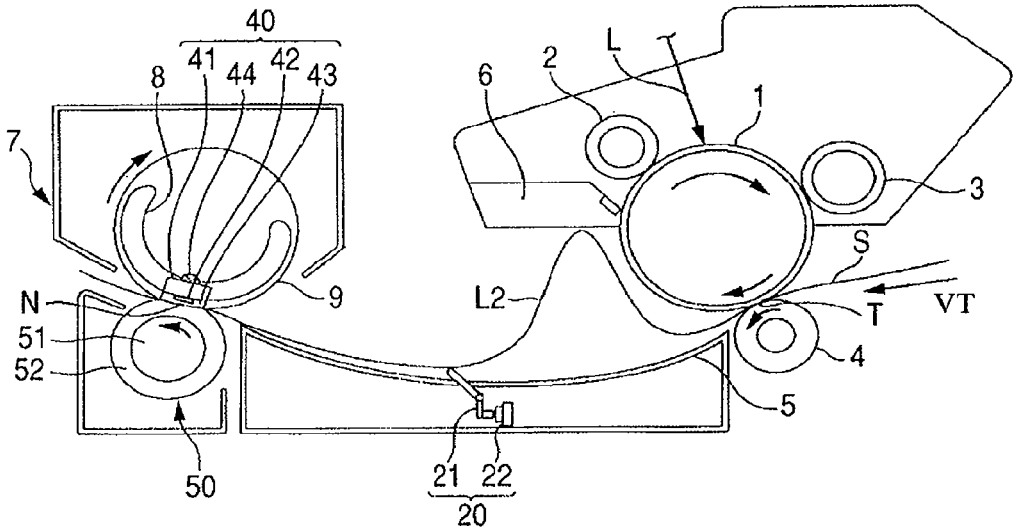

However, even in the case where the distortion L2 of such partial slack occurs, the sheet S is conveyed at a proper location (=height) on the loop detecting sensor 20 and therefore, the distortion L2 cannot be detected and eliminated. Therefore, the distortion L2 gradually grows, and soon is further upwardly increased as shown in FIG. 7B, and the print surface side of the sheet S rubs against the process cartridge 1A installed above to thereby bring about a defective image.

As a measure for avoiding this phenomenon, there is one which quickens the response time until the rotating speed of the fixing motor M2 is changed over in accordance with the ON/OFF of the loop detecting sensor 20. However, even if the response time is thus quickened, this phenomenon cannot be avoided because the sheet S is conveyed with a touch of slip and the influence of a speed reduction from a normal state due to the low speed setting exceeds. Also, the rotating speed of the fixing motor M2 is frequently changed over and therefore, the sheet S is vibrated, thus causing the scattering of the unfixed image or such a fault as the irregular pitch of a halftone image.

Or if the sheet conveying speed is set to the low speed with the fact that the sheet S is conveyed with a touch of slip in the fixing nip N taken into account, a value higher than the speed set value which is originally necessary is made into the low speed. In this case, there may sometimes occur the inconvenience that it becomes impossible to slacken the sheet S, and the sheet S is too much pulled by the fixing nip N.

So, in the embodiment of the present invention, design is made such that when an automatic both-surface printing mode is selected, the sheet conveying speed VF of the fixing device 7 optimum for the second surface (back surface) is calculated after the leading edge of the sheet S on the first surface (front surface) has entered the fixing nip N. Specifically, design is made such that the sheet conveying speed VF of the fixing device 7 optimum for the second surface (back surface) is calculated on the basis of the output of the sheet conveying speed VF of the first surface (front surface) in the fixing nip N (actually the rotating speed of the fixing motor M2).

Design is also made such that when an image is to be formed on the second surface (back surface), the sheet conveying speed VF of the fixing device 7 is controlled so as to be fixed at the sheet conveying speed obtained in this manner, and the sheet S is conveyed.

Figure 8:
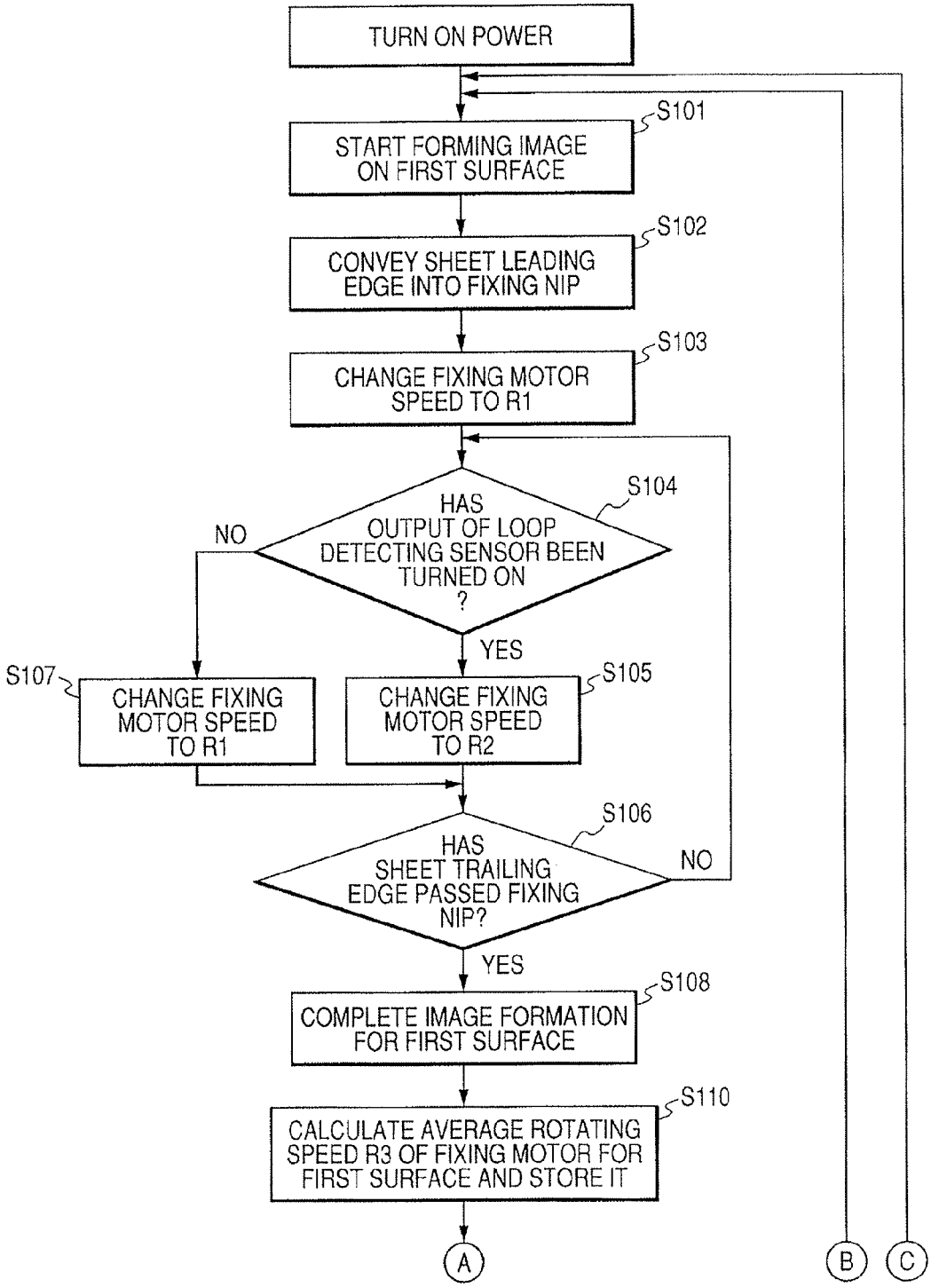
FIG. 8 is a first flow chart showing the sheet conveying speed control from the start of the image forming operation of the fixing device till the end of the image forming operation.
Figure 9:
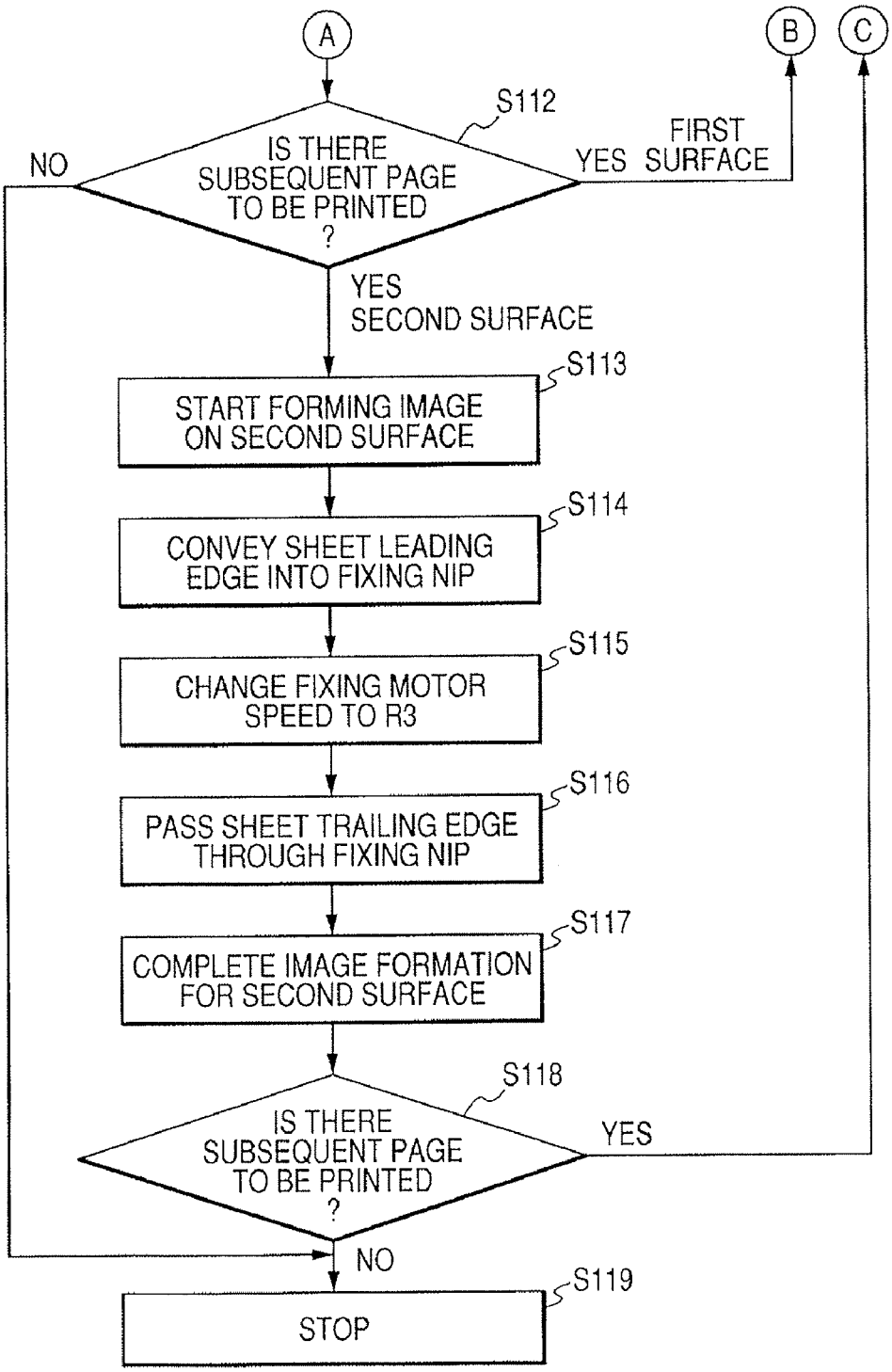
FIG. 9 is a second flow chart showing the sheet conveying speed control from the start of the image forming operation of the fixing device till the end of the image forming operation.

The sheet conveying speed control from the start of the image forming operation of the fixing device (fixing nip N) according to such present embodiment till the end of the image forming operation will now be described with reference to flow charts shown in FIGS. 8 and 9.

First, when an image formation starting signal is inputted after the power supply of the laser beam printer 200 has been turned on, image formation on the first surface of the sheet S is started (S101). Next, the unfixed toner is transferred to the sheet S in the transfer device 204, whereafter the leading edge of the sheet S passes through the transfer nip T (see FIG. 2).

Next, the leading edge of the sheet passes the loop detecting sensor 20 and enters the fixing nip N (S12), whereafter the CPU 30 changes the rotating speed of the fixing motor to R1 (low speed) on the basis of the output of the loop detecting sensor according to the conveyed state of the sheet (S103).

Thereby, a downwardly convex loop is formed in the sheet S as shown in FIG. 5A, and the sheet S in which the downwardly convex loop has been thus formed is conveyed while the underside thereof is in contact with the detecting flag 21. Here, the detecting flag 21 is urged by the spring member as already described and therefore, it is not rocked to a position for turning on the photointerrupter 22 until the loop amount of the sheet S exceeds the reference amount.

However, when the sheet S further progresses, the loop amount of the sheet S comes to gradually increase, and soon the loop amount comes to exceed the reference amount. As the result, the detecting flag 21 is rocked against the urging force of the spring member, whereby the photointerrupter 22 becomes ON and along therewith, the output of the loop detecting sensor 20 becomes ON (YES at S104). When the output of the loop detecting sensor 20 thus becomes ON (YES at S104), the CPU 30 judges that the loop amount of the sheet S has exceeded the reference amount, and changes the rotating speed of the fixing motor M2 from R1 to R2 (S105).

That is, when the output of the loop detecting sensor 20 is ON (YES at S104), the rotating speed of the fixing motor M2 is changed to R2 (high speed) (S105). Also, when the output of the loop detecting sensor 20 is OFF (NO at S104), the rotating speed of the fixing motor M2 is changed to R1 (low speed) (S107). Thereby, the sheet can be conveyed without the slack or pulling thereof being caused.

At this time, depending on the manner of warming of the pressure roller 50, the image pattern, the irregularity of the diameter of each roller, etc., the proportion of the times when the rotating speed of the motor is set to the low speed and the high speed differs.

Figure 10:
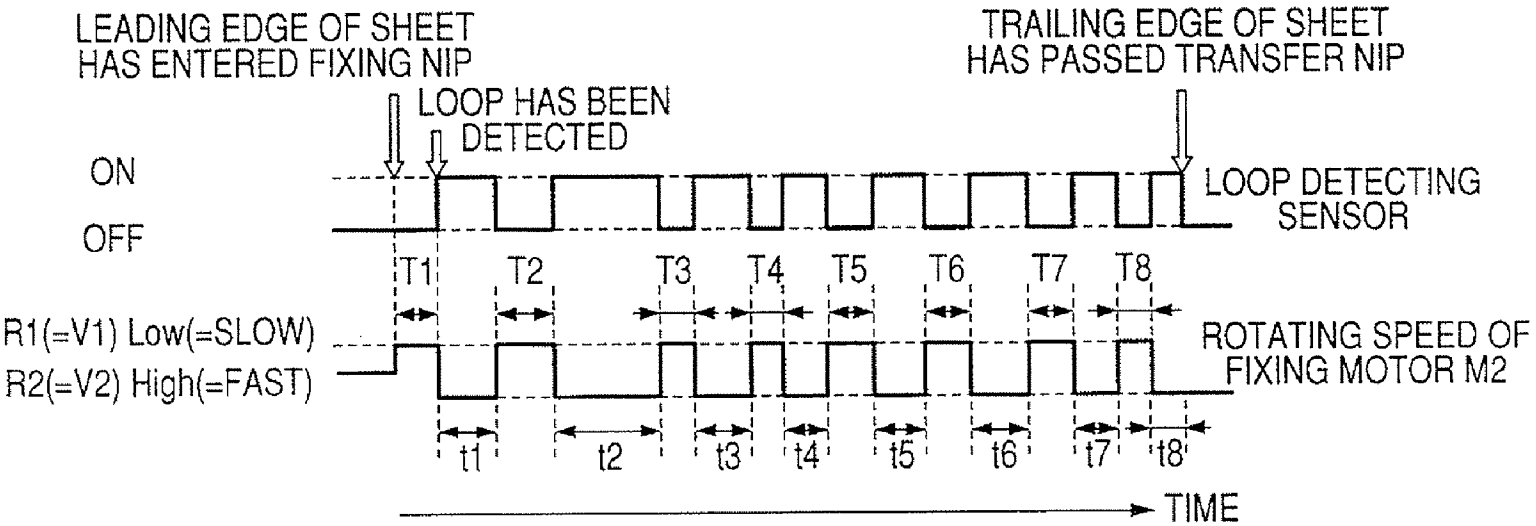
FIG. 10 shows a relation between the output of the loop detecting sensor and the time for which the fixing motor is rotated at a low speed or a high speed.

For example, when the image forming operation is started from the cold state of the fixing device 7, the pressure roller 50 is cold and therefore is not thermally expanded and thus, as shown in FIG. 10, the low speed and the high speed are set at a relatively constant proportion. Also, when the pressure roller 50 is warmed and thermally expanded, the proportion at which the sheet conveying speed is set to the low speed is increased and therefore, as shown in FIG. 11, the proportion at which the sheet conveying speed is set to the high speed is decreased.

In the present embodiment, this rotating speed control of the fixing motor M2 is effected until the trailing edge of the sheet passes through the fixing nip N, and when the trailing edge of the sheet has passed through the fixing nip N (YES at S106), it is judged that the image formation on the first surface has been completed (S108).

Figure 11:
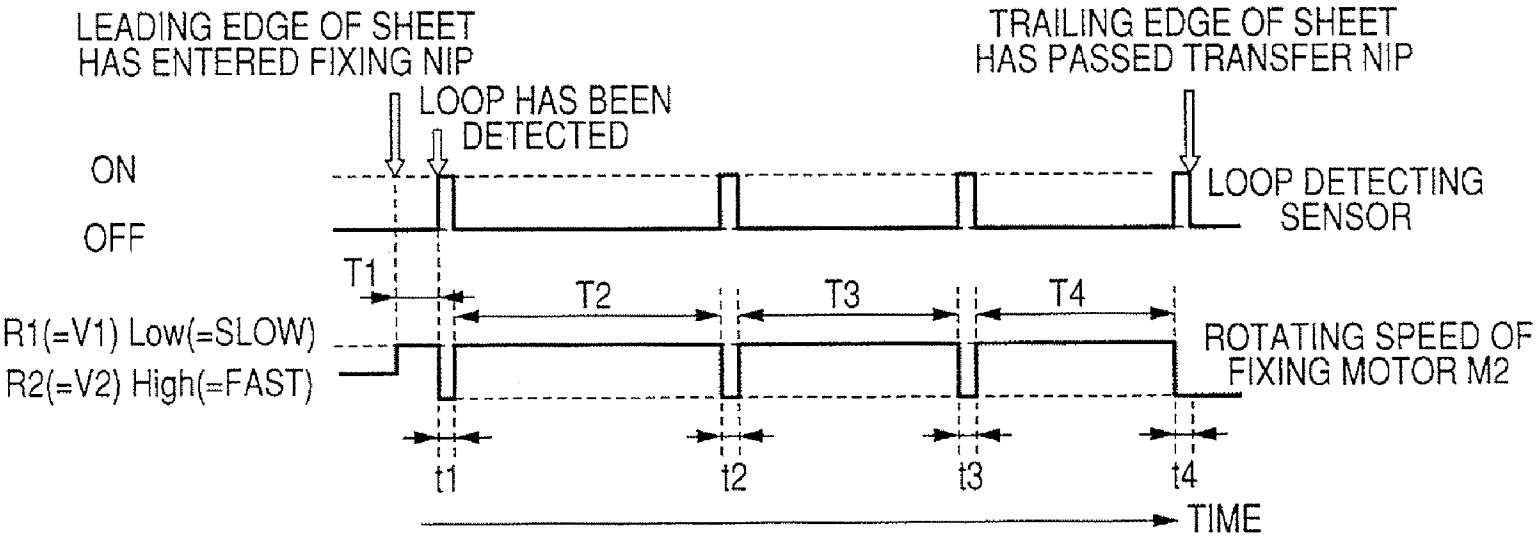
FIG. 11 shows another relation between the output of the loop detecting sensor and the time for which the fixing motor is rotated at a low speed or a high speed.

Thereafter, by the pro of the time shown in FIG. 10 or FIG. 11, the average sheet conveying speed Vave of the fixing nip N (actually the average rotating speed R3 of the fixing motor M2) when the first surface (front surface) of the sheet S has been supplied is calculated and stored (S110) Then, this calculated average sheet conveying speed Vave (actually the average rotating speed R3 of the fixing motor M2) is fixed as the sheet conveying speed for the second surface (back surface).

Here, the average sheet conveying speed Vave of the fixing nip N (actually the average rotating speed of the fixing motor M2) when the first surface (front surface) of this sheet S has been supplied is calculated by the following calculating expression (expression 1). It is to be understood that the section for calculating the average sheet conveying speed Vave is from the timing at which the leading edge of the sheet has passed through the fixing nip N to the timing at which the trailing edge of the sheet has passed through the transfer nip T.

Although the section for calculating the average sheet conveying speed is not particularly restricted, it is preferable to calculate it at the timing during which the sheet S intervenes in both of the fixing nip N and the transfer nip T. Above all, it is important to sufficiently secure the calculating section in order to accurately calculate the average sheet conveying speed Vave $$R3 = \frac{R1 \times (T1 + T2 + \ldots + Tn) + R2 \times (t1 + t2 + \ldots + tn)}{(T1 + T2 + \ldots + Tn) + (t1 + t2 + \ldots + tn)} \quad \text{(Expression 1)}$$

R1 . . . the rotating speed (rpm) of the fixing motor M2 at which the sheet conveying speed VF of the fixing nip N becomes low R2 . . . the rotating speed (rpm) of the fixing motor M2 at which the sheet conveying speed VF of the fixing nip N becomes high R3 . . . the average rotating speed (rpm) of the fixing motor M2 during the sheet supply for the second surface (back surface)

(the rotating speed of the fixing motor M2 at which the average speed of the sheet conveying speed VF of the fixing nip N during the supply of the first surface (front surface) can be obtained)

T1 . . . the time (sec.) for which the sheet conveying speed was set to the low speed during the sheet supply for the first surface t1 . . . the time (sec.) for which the sheet conveying speed was set to the high speed during the sheet supply for the first surface After the average sheet conveying speed Vave of the fixing nip N (the average rotating speed R3 of the fixing motor M2) has been thus calculated and stored, if there is the subsequent page to be printed (second surface, YES at S112), image formation on the second surface is started (S113). Thereafter, the unfixed toner is transferred to the second surface (back surface) of the sheet by the transfer device 204, whereafter the leading edge of the sheet S passes through the transfer nip device (see FIG. 2).

Next, the leading edge of the sheet passes the loop detecting sensor 20 and enters the fixing nip N (S114), whereafter the rotating speed of the fixing motor M2 is changed to the average rotating speed R3 (S115). Then, with the changeover to the average rotating speed R3 of the fixing motor M2, the sheet S is conveyed at the average sheet conveying speed Vave of the first surface (front surface), and soon the trailing edge of the sheet S passes through the fixing nip (S116), whereupon the image formation on the second surface is completed (S117). Thereafter, if there is the subsequent page to be printed (YES at S118), return is made to S101. If there is not the subsequent page to be printed (NO at S118), the image formation is stopped (S119).

In order to confirm the effect of the controlling method of the present embodiment, the following evaluations including a comparative example in which R1 and R2 are successively changed were carried out without the rotating speed of the fixing motor M2 being set to the average rotating speed R3.

<Evaluation 1>

Study Environment: high temperature and high humidity (32° C./80% RH)

Type of the Sheet: EN 100 (A3) paper left under the environment

Image Pattern: halftone

Number of supplied Sheets: continuously 100 sheets

Start of Sheet Supply: cold start (cold state)

The foregoing sheet supply was effected and the number of sheets on which defective images occurred with the halftone image print surfaces thereof being rubbed was counted with the following result.

TABLE 1

| | |
|---|---|
| Comparative Example | 75/100 |
| Present Embodiment | 0/100 |

In the comparative example, as already described, the sheets are conveyed with a touch of slip and the sheet conveying speed is set to the low speed, whereby great slack occurred. In the present embodiment, however, even if the sheet S is conveyed with a touch of slip, the sheet conveying speed is not set to the low speed and the sheet is conveyed at a proper fixed sheet conveying speed according to the situation and therefore, the conveyance of the sheet can be effected while a proper loop amount is always maintained.

Figure 12:
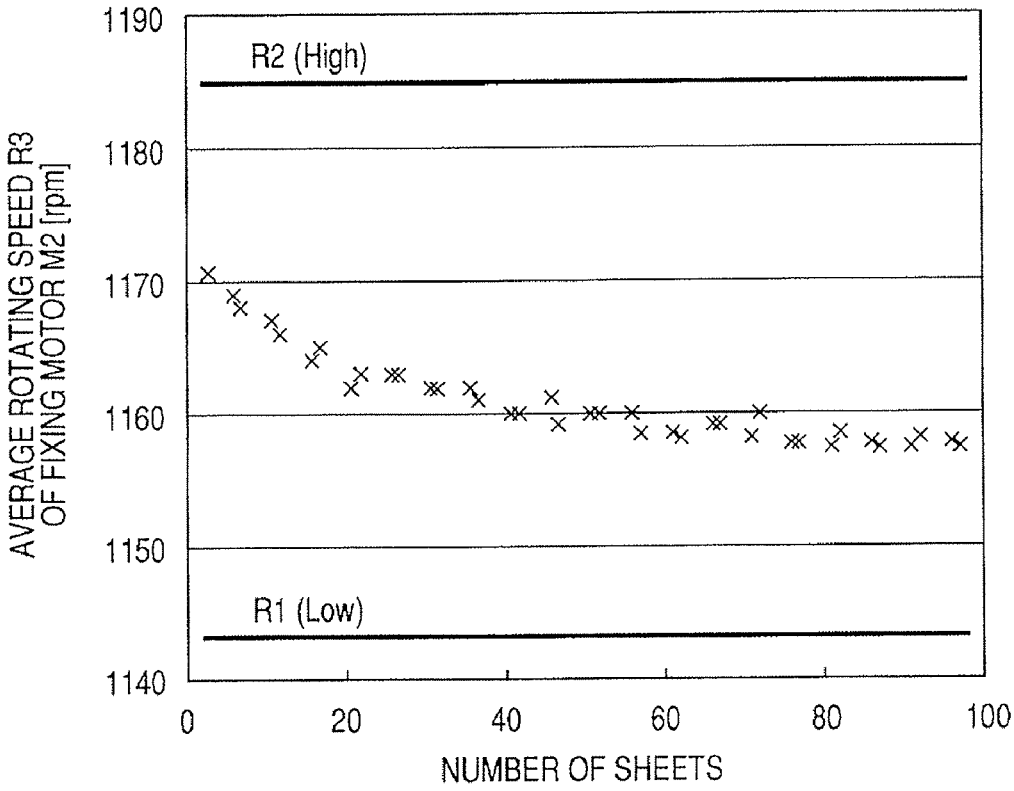
FIG. 12 shows the relation between the average rotating speed of the fixing motor and the number of conveyed sheets.

FIG. 12 shows the transition of the rotating speed of the fixing motor M2 found from Expression 1, and as can be seen from FIG. 12, R3 gradually lowers from the start of the sheet supply to the latter half of the sheet supply. This is because the fixing device (pressure roller 50) is warmed and expanded and therefore the rotating speed of the fixing motor M2 is reduced to thereby control the sheet conveying speed VF in the fixing nip N so as to be substantially the same.

As described above, design is made such that the average sheet conveying speed Vave of the fixing nip N (the average rotating speed of the fixing motor M2) when the first surface (front surface) of the sheet S has been supplied is calculated and that average sheet conveying speed Vave is fixed at the sheet conveying speed for the second surface (back surface).

In other words, when an image is to be formed on the first surface of the sheet S, the sheet conveying speed of the fixing device 7 is controlled by the result of the detection by the loop detecting sensor 20. When an image is to be formed on the second surface, the sheet conveying speed of the fixing device 7 is controlled on the basis of the average sheet conveying speed Vave of the fixing device 7 when an image was formed on the first surface.

While in the present embodiment, design is made such that when an image is to be formed on the second surface, the sheet conveying speed of the fixing device 7 (fixing nip N) is fixed at the calculated average sheet conveying speed Vave (the average rotating speed of the fixing motor M2), but the control value is not restricted to Vave.

According to the inventor's study, if the sheet conveying speed VF of the fixing device 7 (fixing nip N) on the second surface (back surface) is controlled within the following range, even if the sheet is a moisture-absorbent sheet, an appropriate loop can be stably formed in the sheet between the transfer device 204 and the fixing device 7. Thereby, appropriate images can be formed on the both surfaces of the sheet.

$$0.992\times Vave \leqq VF \leqq 1.008\times Vave$$

Here, if the sheet conveying speed VF of the fixing device 7 (fixing nip N) is 0.992×Vave>VF, the setting of the sheet conveying speed is too late, and after the sheet S has entered the fixing nip N, the loop amount becomes too great, and this is not preferable.

Also, if the sheet conveying speed VF is VF>1.008×Vave, the setting of the sheet conveying speed is too early, and after the sheet S has entered the fixing nip N, the loop amount becomes too small, and this is not preferable.

Now, in the description hitherto, description has been made of a case where when an image is to be formed on the second surface, the sheet is conveyed with the sheet conveying speed VF of the fixing nip N as the average sheet conveying speed Vave found by calculating the sheet conveying speed when an image is formed on the first surface.

Or description has been made of a case where the sheet is conveyed with the sheet conveying speed VF of the fixing nip N fixed at the control value set within the range of 0.992×Vave≦VF≦1.008×Vave. However, there is no problem even if the sheet conveying speed VF is changed over to several stages within the range of 0.992×Vave≦VF≦1.008×Vave in accordance with the purpose.

Now, heretofore, various kinds of control have been incorporated in the laser beam printer 200 in order not to cause a defective image while according to a user's various using methods (such as the environment and the type of paper). As one of them, the control of widening the distance between sheets, i.e., the so-called inter-sheet space, is often used. However, when the inter-sheet space is thus widened, the pressure roller 50 of the fixing device 7 is heated and expanded while the inter-sheet space is widened.

When the pressure roller 50 is thus thermally expanded, there may occur a deviation, in such a controlling method as described in the first embodiment, between the set value of the sheet conveying speed for the second surface (back surface) (actually the rotating speed of the fixing motor M2 and an optimum set value.

Therefore, if the time from after the first surface (front surface) has passed through the fixing nip N until the second surface (back surface) is again conveyed to the fixing nip N is longer than a reference time, it is preferable to correct the average sheet conveying speed Vave obtained in the first embodiment already described.

Description will now be made of a second embodiment of the present invention designed such that when as described above, the time from after the first surface has passed through the fixing nip N until the second surface is again conveyed to the fixing nip N exceeds the predetermined reference time, the average sheet conveying speed Vave is corrected.

In the present embodiment, design is made such that the average sheet conveying speed is corrected from Expression 2 below by the use of a time added from the normal operation, i.e., a time exceeding a correction reference time which is the predetermined reference time, and the average sheet conveying speed of the fixing nip N.

Design is also made such that a sheet conveying speed Vave' obtained from this Expression 2 (actually the rotating speed R3' of the fixing motor M2) is fixed as the sheet conveying speed for the second surface (back surface).

$$R3=R3\times(1-0.001\times t) \qquad \text{(Expression 2)}$$

R3 . . . the rotating speed (rpm) of the fixing motor M2 during the sheet supply for the second surface (back surface)

(the rotating speed of the fixing motor M2 at which the average speed of the sheet conveying speed Vf of the fixing nip N during the sheet supply of the first surface (front surface) can be obtained)

R3' . . . the rotating speed (rpm) of the fixing motor M2 during the sheet supply for the second surface (back surface) after the correction t . . . a time (second) exceeding the correction reference time The foregoing Expression 2 is the control of lowering the rotating speed of the fixing motor M2 by 0.1% each time the time for widening the inter-sheet space extends by 1 second. This reduction rate of the rotating speed of the fixing motor M2 differs in its optimum value depending on the construction of the fixing device used, the fixing heater controlling method, etc. and therefore, it is necessary to suitably adjust it in accordance with the apparatus used.

In such present embodiment, evaluations similar to those in the first embodiment already described were carried out with a result that there was not the occurrence of a defective image. By using the controlling method of the present embodiment, it becomes possible to cope also with the controlling methods for various other printers, and always form a stable loop amount to thereby suppress the occurrence of a defective image even during the automatic both-surface printing under a high-temperature and high-humidity environment.

Also, in a case where the inter-sheet space has extremely extended (a long time has been taken), for example, in a case where a standby state is brought about on a sheet re-feeding and conveying path when other sheet is jammed or when sheets have become exhausted in a cassette sheet supplying portion, it is preferable that return be made to the loop control of the first surface (front surface).

That is, in the case where the inter-sheet space has extremely extended (a long time has been taken), the time from after the first surface has passed through the fixing nip N until the second surface is again conveyed to the fixing nip N may greatly exceed the predetermined correction reference time and become the predetermined control reference time. In this case, it is preferable that as the sheet conveying speed control of the fixing device 7 when an image is formed on the second surface, it is preferable to effect the sheet conveying speed control of the fixing device 7 when an image is formed on the first surface.

This is because if the standby state is long, not only a deviation correspondingly occurs also to the correction value, but if the standby state is too long, the steam adhering to the front surface of the sheet which is the original cause is gasified and the influence thereof does not reach the sheet conveyance.

While the present embodiment has been described above, the present invention is not restricted to this embodiment. For example, while in the present embodiment, description has been made of the control of conveying the sheet while forming a loop in the sheet between the transfer device and the fixing device on the basis of the detection by the loop detecting sensor when an image is formed on the first surface of the sheet, this is not restrictive. Use may be made of such control as described in the background art wherein the circumferential speed of the roller of the fixing device is made changeable over to a first circumferential speed lower than the sheet conveying speed in the transfer device and a second circumferential speed higher than the first circumferential speed, and is changed over from the first circumferential speed to the second circumferential speed after the lapse of a predetermined time after the sheet has arrived at the fixing device.

Also, while in the present embodiment, the conveyance control of the sheet between the transfer device and the fixing device is effected by the sheet conveying speed in the transfer device being made constant and the sheet conveying speed in the fixing device being made variable, the present invention is not restricted thereto. For example, the conveyance control of the sheet between the transfer device and the fixing device can be effected with the sheet conveying speed made variable in the transfer device or both of the transfer device and the fixing device.

This application claims the benefit of Japanese Patent Application Nos. 2005-356415 filed Dec. 9, 2005, and 2006-272636 filed Oct. 4, 2006 which are hereby incorporated by reference herein in their entirety.

What is claimed is:

1. An image forming apparatus for transferring and fixing a toner image on a first surface of a sheet in an image forming portion, and thereafter reversing the sheet and again conveying the sheet to said image forming portion, and transferring and fixing a toner image on a second surface of the sheet to thereby form images on the both surfaces of the sheet, said image forming apparatus comprising:

a transfer device configured to transfer the toner image to the sheet;

a fixing device configured to fix the toner image transferred by said transfer device on the sheet; and speed controlling means configured to control a sheet conveying speed between said transfer device and said fixing device, wherein in a case of forming the image on the first surface of the sheet, said speed controlling means controls the sheet conveying speed between said transfer device and said fixing device on the basis of an amount of a loop formed in the sheet by a difference between sheet conveying speeds of said transfer device and said fixing device, and in a case of forming the image on the second surface of the sheet, said speed controlling means controls the sheet conveying speed between said transfer device and said fixing device on the basis of an average sheet conveying speed of the sheet conveyed between said transfer device and said fixing device when the image has been formed on the first surface.

2. An image forming apparatus according to claim 1, further comprising loop detecting means configured to detect the loop of the sheet formed by the difference between the sheet conveying speeds of said transfer device and said fixing device, wherein in a case of forming the image on the first surface, said speed controlling means controls the sheet conveying speed of said fixing device higher than the sheet conveying speed of said transfer device when it is judged on the basis of a detection result of said loop detecting means that the loop amount of the sheet has exceeded a reference amount, and controls the sheet conveying speed of said fixing device lower than the sheet conveying speed of said transfer device when it is judged on the basis of the detection result of said loop detecting means that the loop amount of the sheet has fallen below the reference amount.

3. An image forming apparatus according to claim 2, wherein the sheet conveying speed of said transfer device is made constant, and said speed controlling means increases or decreases the sheet conveying speed of said fixing device and sets the sheet conveying speed between said transfer device and said fixing device.

4. An image forming apparatus according to claim 1, wherein said speed controlling means controls the sheet conveying speed between said transfer device and said fixing device when the image is to be formed on the second surface so as to be the same as the average sheet conveying speed.

5. An image forming apparatus according to claim 1, wherein when the sheet conveying speed of said transfer device is made constant, and when the sheet conveying speed of said fixing device when the image is to be formed on the second surface is defined as VF, and when the average sheet conveying speed is defined as Vave, said speed controlling means controls the sheet conveying speed so that VF is fallen within a range of $$0.992 \times Vave \leqq VF \leqq 1.008 \times Vave.$$

6. An image forming apparatus according to claim 1, further comprising:

a pressure roller constituting said fixing device; and a motor for driving said pressure roller, wherein in a case where a time from after the sheet to the first surface of which the toner image has been transferred has passed through said fixing device until the sheet to the second surface of which the toner image has been transferred is conveyed to said fixing device has exceeded a correction reference time, said speed controlling means corrects the average sheet conveying speed so as to decrease a rotating speed of said motor.

7. An image forming apparatus according to claim 6, wherein said speed controlling means controls the sheet conveying speed when the image is to be formed on the second surface under a sheet conveying speed control when the image is to be formed on the first surface, in a case in which the time from after the sheet to the first surface of which the toner image has been transferred has passed through said fixing device until the sheet to the second surface of which the toner image has been transferred is conveyed to said fixing device has exceeded a control reference time longer than the correction reference time.

* * * * *

UNITED STATES PATENT AND TRADEMARK OFFICE

CERTIFICATE OF CORRECTION

PATENT NO. : 7,426,353 B1
APPLICATION NO. : 11/559603
DATED : September 16, 2008
INVENTOR(S) : Sakakibara It is certified that error appears in the above-identified patent and that said Letters Patent is hereby corrected as shown below:

COLUMN 13:
Line 65, “surface” should read --surface.--.

COLUMN 16:
Line 17, “R3=R3×(1-0.001×+)” should read --R3'=R3×(1-0.001×t)--.

Signed and Sealed this

Third Day of February, 2009

John Doll

JOHN DOLL
*Acting Director of the United States Patent and Trademark Office*